US011305296B2

(12) United States Patent
Hallot et al.

(10) Patent No.: US 11,305,296 B2
(45) Date of Patent: Apr. 19, 2022

(54) MULTIPHASE FLUID DISPENSER

(71) Applicant: SAIPEM S.A., Montigny le Bretonneux (FR)

(72) Inventors: Raymond Hallot, Voisins le Bretonneux (FR); Sadia Shaiek, Courbevoie (FR); Thomas Valdenaire, Paris (FR)

(73) Assignee: SAIPEM S.A., Montigny le (FR)

( * ) Notice: Subject to any disclaimer, the term of this patent is extended or adjusted under 35 U.S.C. 154(b) by 249 days.

(21) Appl. No.: 16/613,966

(22) PCT Filed: Mar. 29, 2018

(86) PCT No.: PCT/FR2018/050777

§ 371 (c)(1),
(2) Date: Nov. 15, 2019

(87) PCT Pub. No.: WO2018/211183

PCT Pub. Date: Nov. 22, 2018

(65) Prior Publication Data

US 2021/0069731 A1 Mar. 11, 2021

(30) Foreign Application Priority Data

May 16, 2017 (FR) ..... 17 54301

(51) Int. Cl.
*B04C 3/06* (2006.01)
*B04C 3/00* (2006.01)

(52) U.S. Cl.
CPC ..... *B04C 3/06* (2013.01); *B04C 2003/006* (2013.01)

(58) Field of Classification Search
CPC ..... B04C 3/00; B04C 3/06; B04C 2003/006; B04C 5/085
See application file for complete search history.

(56) References Cited

U.S. PATENT DOCUMENTS 2,154,779 A * 4/1939 Thomas ..... B04C 3/00 209/179
3,010,579 A * 11/1961 Clarence ..... B04C 3/00 209/210

(Continued)

FOREIGN PATENT DOCUMENTS

FR 2935065 A1 2/2010
WO 2008085042 A1 7/2008
WO 2010131958 A1 11/2010

OTHER PUBLICATIONS

French Search Report from FR Application No. FR1754301, Feb. 7, 2018.

(Continued)

*Primary Examiner* — David C Mellon
(74) *Attorney, Agent, or Firm* — Workman Nydegger

(57) ABSTRACT

A multiphase fluid manifold comprises a cylindrical enclosure having, at one longitudinal end, an inlet orifice and, at an opposite longitudinal end, a plurality of cylindrical outlet orifices of the same right section that are regularly distributed around a longitudinal axis of the enclosure and that are aligned in a common plane extending transversely to the enclosure, each of the inlet and outlet orifices leading to or from the inside of the enclosure along a direction that is substantially tangential to the enclosure.

11 Claims, 3 Drawing Sheets

(56) References Cited

U.S. PATENT DOCUMENTS

| | | | | |
|---|---|---|---|---|
| 4,053,291 | A * | 10/1977 | Sims | B01D 19/0057 96/209 |
| 4,599,163 | A * | 7/1986 | Manola | B07B 9/02 209/139.2 |
| 5,085,677 | A * | 2/1992 | Ville | B01D 36/045 96/210 |
| 9,666,315 | B2 | 5/2017 | Mizuguchi et al. | |
| 2005/0103691 | A1* | 5/2005 | Hakola | B04C 5/13 209/715 |
| 2009/0205162 | A1 | 8/2009 | Oh et al. | |
| 2010/0038249 | A1 | 2/2010 | Mizuguchi et al. | |
| 2010/0064893 | A1* | 3/2010 | Hopper | B04C 5/13 210/787 |
| 2019/0358652 | A1* | 11/2019 | Glaves | B04C 5/02 |

OTHER PUBLICATIONS

International Search Report & Written Opinion from PCT Application No. PCT/FR2018/050777, dated Jul. 11, 2018.

* cited by examiner

MULTIPHASE FLUID DISPENSER

BACKGROUND OF THE INVENTION

The present invention relates to the general field of manifolds for multiphase fluids serving to take a flow of fluid made up of a plurality of different phases, and to subdivide the flow in equal portions into a plurality of fluid flows, each having the same flow rate and the same composition.

A particular field of application of the invention relates to undersea effluent-treatment equipment for use in producing hydrocarbons, e.g. oil and gas, coming from undersea production wells.

Subjecting hydrocarbons coming from undersea production wells to treatment undersea is becoming a real need for optimizing production, in particular at great depths. Among various means used for undersea treatment of hydrocarbons, it is known to have recourse to undersea gravity separators of the gas/liquid type, referred to as "multi-pipe separators" or as "condensate traps", that serve both to optimize production from wells, and also to manage stopping and restarting production by depressurizing production lines. It is also known to have recourse to undersea gravity separators of the liquid/liquid type (i.e. specifically oil/water), which are used for increasing the recovery of oil and for re-injecting the water that is recovered into the production wells.

For applications at great depth, these various undersea gravity separators are advantageously segmented, i.e. they are made up of a plurality of cylindrical enclosures of small-diameter working in parallel; they require the use of a common principle consisting in distributing the multiphase fluid (i.e. a fluid having a gas phase and a liquid phase) as a plurality of identical multiphase fluid flows, all at the same rate and all of the same composition. This function is typically performed by a manifold having an inlet that receives the multiphase fluid and that separates it at its outlets into a plurality of multiphase fluid flows, all having the same flow rate.

Another particular field of application of the invention lies in sharing a multiphase hydrocarbon production fluid uniformly among the multiple branches of a heat exchanger or among multiple heat exchangers operating in parallel, for the purpose of cooling or heating the production fluid.

Yet another particular field of application of the invention lies in sharing a production gas uniformly among the multiple branches of a condenser or among multiple condensers operating in parallel, for the purpose of drying or condensing the light phases of the gas, so as to condition the gas prior to it being transported along a low-temperature pipeline.

The manifolds known in the prior art generally comprise a cylindrical inlet, of size close to the size of the feed pipe, with a succession of small orifices in an axisymmetric arrangement opening out from its end. In order to ensure that such sharing is relatively insensitive to flow conditions, the manifold is generally arranged vertically with its inlet at the bottom and its outlet orifices at the top, so as to cancel out any effects that gravity might have on where the phases are located immediately before being delivered. Furthermore, the feed pipe is advantageously positioned vertically and is of a length greater than ten times its diameter so that the multiphase flow presents an axisymmetric appearance (at least on average over a period of a few seconds), which is a prerequisite for sharing to be uniform.

Depending on the intended application, such manifolds may present certain limits.

Such manifolds having a height of several meters makes them bulky, which can be problematic for the configuration of the undersea installation, particularly when the installations downstream from the manifold are low down.

Furthermore, as a result of their function of sharing the incoming stream as a whole, such manifolds do not serve to separate gas from liquid. However, in order to optimize the size of equipment downstream, or for reasons of efficiency, it can be necessary to extract the gas phase in order to share only the liquid phases to the treatment installations located downstream. Specifically, it would be highly advantageous to extract the gas phase at the manifold in order to bypass the liquid/liquid (e.g. water/oil) separators or the heat exchangers or other equipment, with the gas phase then being reinjected downstream from the treatment, since the efficiency and the size of such equipment are significantly affected by the quantity of gas passing through it.

OBJECT AND SUMMARY OF THE INVENTION

A main object of the present invention is thus to propose a multiphase fluid manifold that does not present the above-mentioned drawbacks.

In accordance with the invention, this object is achieved by a multiphase fluid manifold comprising a cylindrical enclosure having, at one longitudinal end, an inlet orifice and, at an opposite longitudinal end, a plurality of cylindrical outlet orifices of the same right section that are regularly distributed around a longitudinal axis of the enclosure and that are aligned in a common plane extending transversely to the enclosure, each of the inlet and outlet orifices leading to or from the inside of the enclosure along a direction that is substantially tangential to the enclosure.

The manifold of the invention operates as follows: the multiphase fluid penetrates to the inside of the enclosure via the inlet orifice, while being injected tangentially thereto. As a result of centrifugal force, the liquid phase of a gas/liquid fluid becomes pressed against the inside wall of the enclosure so as to form a liquid film flowing with helical gyratory motion, while the gaseous portion of the gas/liquid fluid forms a central gaseous flow passing longitudinally upwards at the center of the liquid film. The multiphase fluid entering into the enclosure as directed towards the opposite end of the enclosure in such a manner that the particles of the liquid film as created in this way follow upward helical paths. On reaching the opposite end of the enclosure, the liquid film is ejected under the effect of centrifugal force out from the enclosure by passing through the outlet orifices. The gas phase of the multiphase fluid accumulates in the center of the high portion of the enclosure and can flow out through the top portions of the outlet orifices. Nevertheless, if the liquid film occupies the sections of these orifices in full, the pressure of the gas phase increases until it escapes periodically through the outlet orifices by passing through the liquid film when its pressure becomes greater than the pressure of the outlet orifices (rapid pulsation phenomenon).

Uniform sharing of the various phases of the multiphase fluid is thus a result of the axial symmetry of the manifold and of the axial symmetry of the flow within the enclosure. Furthermore, it has been found that the multiphase fluid is uniformly discharged via the various outlet orifices providing the fluid is centrifuged at sufficient speed, and providing the pulsation of the intermittent expulsion of the gas phase of the multiphase fluid likewise takes place in uniform manner.

For this purpose, it is necessary within the enclosure to have a minimum tangential speed of 0.8 meters per second (m/s) and a minimum axial speed of 0.1 m/s for all of the phases in combination. The speeds are obtained by appropriately dimensioning the enclosure and its internal elements as a function of the fluid flow rates that are to be taken into consideration. The pulsation with which the gas phase is expelled through the liquid film in front of the outlet orifices takes place in uniform manner, providing the pressures that exist in each of the outlet orifices are substantially uniform.

Preferably, the manifold of the invention also has fluid guide means for imparting helical motion to the fluid flowing inside the enclosure from the inlet orifice towards the outlet orifices.

The fluid guide means may advantageously comprise a guide ramp in the form of a helix centered on the longitudinal axis of the enclosure. Under such circumstances, the guide ramp may be carried either by a cylinder centered on the longitudinal axis of the enclosure, or else by an inside wall of the enclosure. When carried by a cylinder, the cylinder also advantageously carries a deflector positioned facing the inlet orifice to assist the fluid in being guided by the guide ramp.

Furthermore, the inlet orifice advantageously leads to the inside of the enclosure while forming an angle sloping towards the outlet orifices. The inlet orifice may form an angle with a transverse axis of the enclosure that is substantially equal to the helix angle of the guide ramp. Preferably, the angle formed by the inlet orifice and by the helix of the guide ramp relative to the transverse axis of the enclosure lies in the range of 5° to 30°.

The manifold may further comprise a ring of erosion-resistant material centered on the longitudinal axis of the enclosure and positioned inside it, said ring being provided with a plurality of fluid-passing slots, each positioned in register with a respective outlet orifice.

For certain applications, e.g. such as liquid/liquid separators or heat exchangers, the enclosure may further comprise a gas exhaust orifice centered on the longitudinal axis of the enclosure and situated at the longitudinal end of the enclosure where the outlet orifices are positioned. This exhaust orifice enables as much gas as possible to be extracted upstream from the fluid outlet orifices so as to minimize the gas content of the fluid delivered through them.

The enclosure may be formed by a sealed assembly of a vessel and a lid, the inlet orifice being formed in the vessel and the outlet orifices being formed in the lid.

Preferably, the fluid guide means are configured to enable the fluid to make two turns around the longitudinal axis of the enclosure on going from the inlet orifice to the outlet orifices. This characteristic makes it possible to obtain an enclosure that is very compact by reducing the distance travelled between the inlet orifice and the outlet orifices.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

Figure 1:
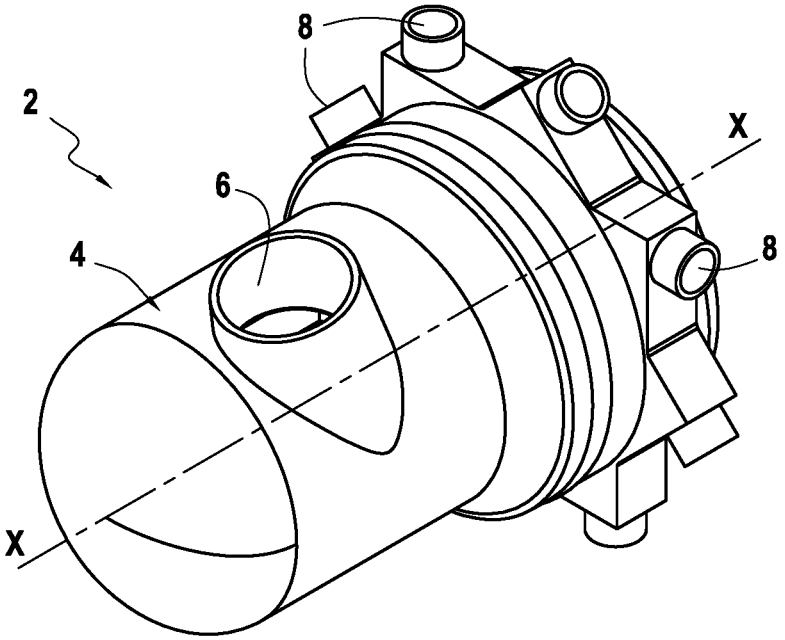
FIG. 1 is a perspective view of a manifold in an embodiment of the invention.

The invention relates to a multiphase fluid manifold for fitting to undersea effluent-treatment equipment, in particular to segmented gravity separators, which are used in hydrocarbon production at great depths offshore.

The term "multiphase fluid" is used herein to mean a fluid comprising at least two different phases, e.g. a liquid phase and a gas phase.

FIGS. 1 to 5 show a manifold 2 in a first embodiment of the invention.

The manifold 2 comprises in particular a cylindrical enclosure 4 having a longitudinal axis X-X that is positioned vertically. At its bottom longitudinal end, the enclosure 4 has an inlet orifice 6 for the multiphase fluid. At its top longitudinal end, opposite from the bottom end, the enclosure presents a plurality of cylindrical outlet orifices 8.

More precisely, the inlet orifice 6 leads into the enclosure 4 along a direction that firstly is substantially tangential to the enclosure, and that secondly forms an angle $\alpha$ with a transverse axis Y-Y of the enclosure, which angle slopes towards the outlet orifices 8. This angle $\alpha$ preferably lies in the range 5° to 30°.

As a result, the multiphase fluid penetrates into the enclosure of the manifold in its lower portion while travelling with upward helical motion around the longitudinal axis X-X of the enclosure. The tangential orientation of the inlet orifice serves in particular to limit the impact of the jet of multiphase fluid against the inside wall of the enclosure and to facilitate the rapid formation of a helically rotating film of liquid that is pressed against the inside wall of the body of the manifold 4.

In the embodiment shown in FIGS. 1 to 5, the number of outlet orifices 8 is eight and they are regularly distributed around the longitudinal axis X-X of the enclosure.

Furthermore, each of the outlet orifices 8 is cylindrical in shape about a respective longitudinal axis 8*a*, all of these longitudinal axes 8*a* being situated in a common transverse plane P of the enclosure 4. The (circularly-shaped) right sections of the outlet orifices are identical for all of the outlet orifices, and they depart from the inside of the enclosure in directions that are substantially tangential thereto.

Figure 5:
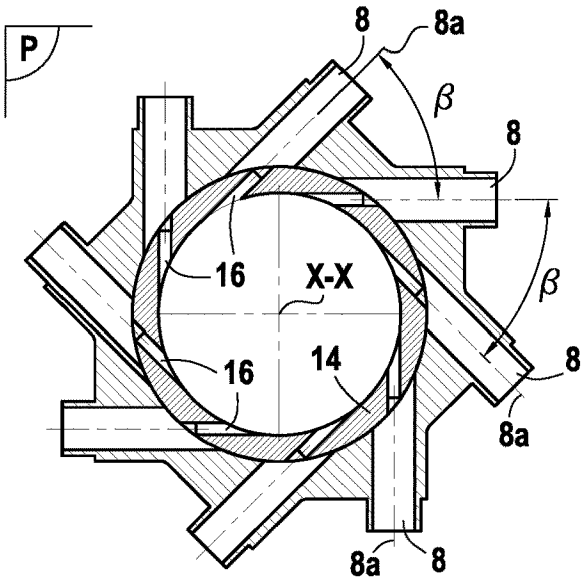

Furthermore, as shown in FIG. 5, the respective longitudinal axes 8*a* of adjacent outlet orifices 8 form between them an angle $\beta$ that is preferably less than 30°, this angle $\beta$ being the same for all of the outlet orifices.

Thus, the distribution of the outlet orifices 8 presents axial symmetry about the longitudinal axis X-X. As a result, when the liquid that is pressed against the inside wall of the enclosure and that is travelling with upward helical motion around the longitudinal axis X-X of the enclosure reaches the level of the transverse plane P, it is ejected under the effect of centrifugal force into all of the outlet orifices, with the flow rate of fluid ejected by each outlet orifice being substantially the same for all of the outlet orifices as a result of the regularity of the thickness of the liquid film and of its upward helical motion.

The manifold of the invention also has fluid guide means for imparting helical motion to the fluid flowing inside the enclosure from the inlet orifice towards the outlet orifices.

For this purpose, a guide ramp 10 in the form of a helix centered on the longitudinal axis X-X of the enclosure 4 of the manifold is positioned inside the enclosure between the inlet orifice 6 and the outlet orifices 8.

Figure 4:
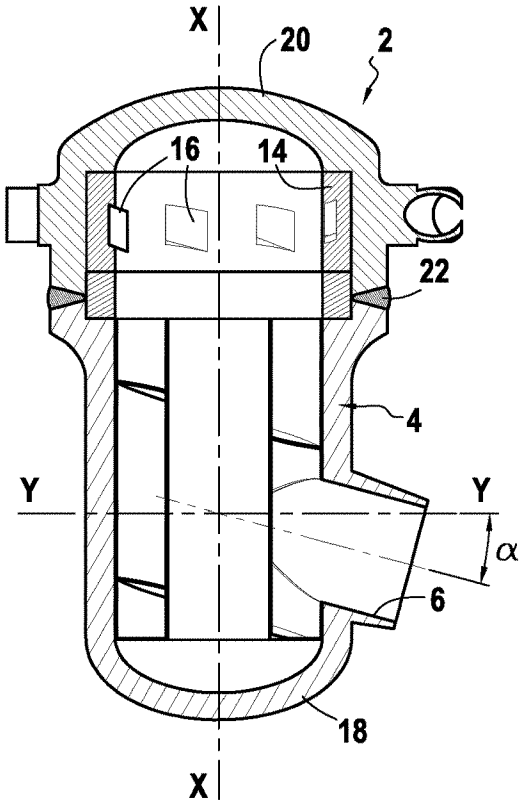
FIGS. 3 to 5 are section views of FIG. 2, respectively on IV-IV, and V-V.
Figure 3:
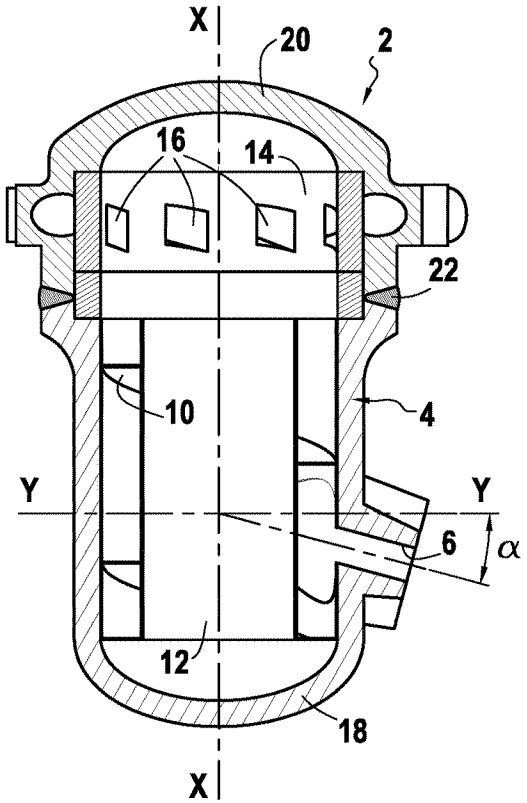
Figure 2:
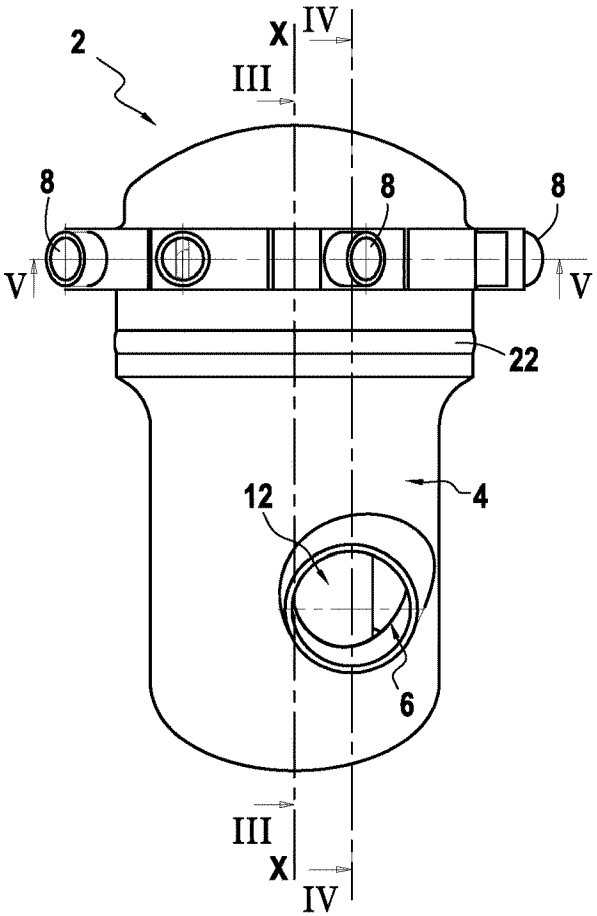
FIG. 2 is a side view of the FIG. 1 manifold.

As shown in FIGS. 3 and 4, this guide ramp 10 of helical shape may be carried, more precisely, by a cylinder 12 that is centered on the longitudinal axis X-X of the enclosure. Alternatively, the guide ramp could be carried by the inside wall of the enclosure.

Furthermore, the orientation and the angle formed by the helix of the guide ramp 10 with a transverse axis Y-Y of the enclosure are identical to the orientation and to the angle $\alpha$ formed by the inlet orifice 6 with that transverse axis.

The operation of the manifold 2 stems from the above. The multiphase fluid penetrates low down into the enclosure 4 of the manifold in a manner that is tangential relative thereto, and it is directed towards the top of the manifold at an angle lying in the range 5° to 30° relative to the horizontal. Under the effect of centrifugal force, the liquid phase of the multiphase fluid develops a liquid film that is pressed against the inside wall of the enclosure, this liquid film being guided by the guide ramp 10, if any, so as to be directed towards the high portion of the enclosure where the outlet orifices 8 are positioned. The gas phase of the multiphase fluid becomes concentrated in the center of the enclosure while rising towards the top of the enclosure.

On reaching the high portion of the enclosure and under the effect of centrifugal force, the liquid film flowing helically around the longitudinal axis X-X is ejected out from the enclosure into each of the outlet orifices 8, while being shared in equal manner among all of the outlet orifices. The gas phase of the multiphase fluid accumulates in the center of the high portion of the enclosure and can flow out through the top portions of the outlet orifices. Nevertheless, if the liquid film occupies the sections of these orifices in full, the pressure of the gas phase increases until it escapes periodically through the outlet orifices 8 whenever its pressure exceeds the pressure of the outlet orifices (phenomenon of pulsation).

In the embodiment of FIGS. 1 to 4 it should be observed that the manifold 2 also has a ring 14 that is centered on the longitudinal axis X-X of the enclosure and that is positioned inside the enclosure, this ring being provided with a plurality of fluid-passing slots 16, each of which is positioned in register with a respective outlet orifice 8.

The presence of this ring 14 with its fluid-passing slots 16 upstream from the outlet orifices 8 has the advantage of making it possible to use materials that withstand erosion, such as ceramics, tungsten carbides, etc. in zones that present sharp edges that need to be protected from the erosion that can be caused by high speeds of flow and solid particles potentially entrained by the fluid, while continuing to be able to use more conventional materials for the other portions of the manifold, which more conventional materials are less expensive and easier to machine, such as carbon steel, iron-nickel alloys, etc.

Still in the embodiment of FIGS. 1 to 4, it should also be observed that the enclosure 4 is formed by assembling together a vessel 18 and a lid 20, the inlet orifice 6 being formed in the vessel 18, and the outlet orifices 8 being formed in the lid. This assembly is sealed by means of an annular bead of welding 22 between those two elements.

Figure 8:
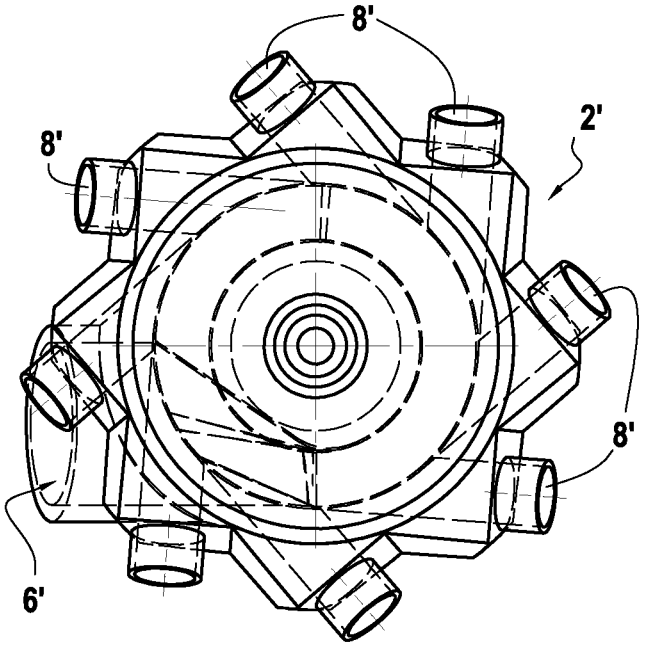
FIG. 8 is a cross-section view of the manifold showing its outlet orifices.
Figure 7:
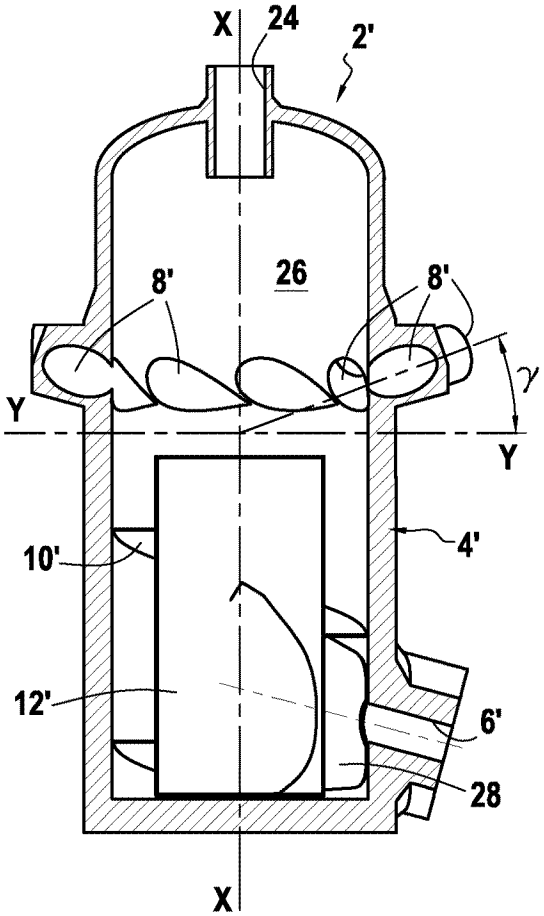
FIG. 7 is a section view on VII-VII of the FIG. 7 manifold.
Figure 6:
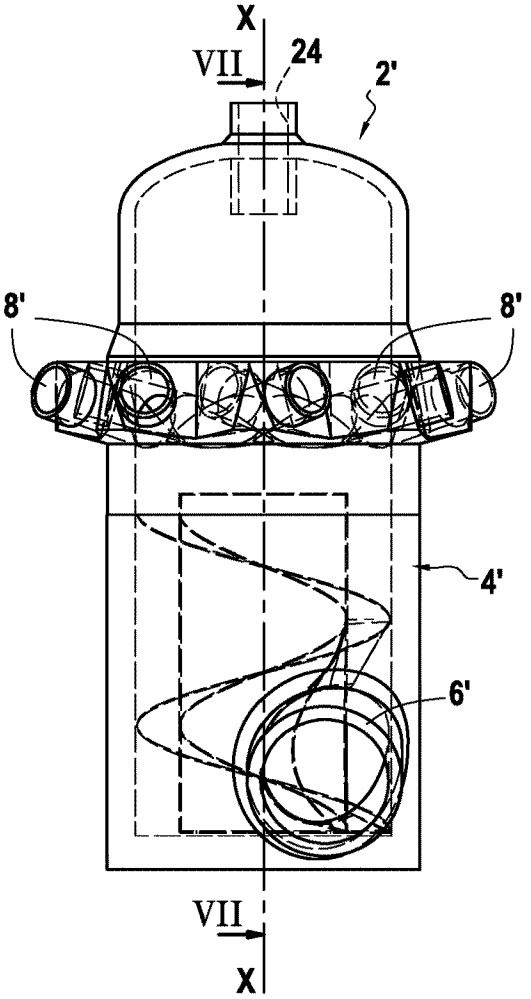
FIG. 6 is a side view of a manifold in another embodiment of the invention.

With reference to FIGS. 6 to 8, there follows a description of a manifold in a second embodiment of the invention. In this second embodiment, the manifold is used for example in an undersea gravity separator of the oil/water type, or in a multi-tube heat exchanger.

With this type of treatment, and depending on the specifications of each particular application (size, weight, efficiency), it may be necessary to extract as much gas as possible from the multiphase fluid upstream from the fluid being shared in order to minimize the gas contents of the fluids at the outlets from the manifold, and thus at the inlets of the treatment equipment.

For this purpose, and compared with the above-described first embodiment, the enclosure 4' of the manifold 2' in this second embodiment also has a gas exhaust orifice 24 that is centered on the longitudinal axis X-X of the enclosure and that is situated at the longitudinal end of the enclosure where the outlet orifices 8' are positioned. Furthermore, a buffer zone 26 is arranged within the enclosure 4' between the outlet orifices 8' and the gas exhaust orifice 24.

This manifold 2' operates as follows. The multiphase fluid penetrates into the enclosure 4' of the manifold in a manner that is tangential relative thereto, and it is directed towards the top of the manifold at an angle lying in the range 5° to 30° relative to the horizontal. Under the effect of centrifugal force, the liquid phase of the multiphase fluid develops a liquid film that is pressed against the inside wall of the enclosure, this liquid film being guided by the guide ramp 10', if any, so as to be directed towards the high portion of the enclosure where the outlet orifices 8' are positioned. The gas phase of the multiphase fluid becomes concentrated in the center of the enclosure while rising towards the top of the enclosure.

On reaching the high portion of the enclosure and under the effect of centrifugal force, the liquid film flowing helically around the longitudinal axis X-X of the enclosure 4' is ejected out from the enclosure into each of the outlet orifices 8', while being shared in equal manner among all of the outlet orifices.

The gas phase of the multiphase fluid accumulates in the buffer zone 26 in the high portion of the enclosure 4'. In this buffer zone, the gas loses its last drops of liquid, which are entrained radially by centrifugal force and vertically by their own weight so as to join the liquid film and be discharged through the outlet orifices 8'. When the pressure of the gas in the buffer zone exceeds the pressure of the gas exhaust orifice 24, the gas phase of the multiphase fluid is discharged via the gas exhaust orifice and also via the outlet orifices, providing that the pressure that exists therein remains strictly lower than the pressure that exists in the outlet orifices 8'.

Provision may be made to position a coalescer system (a grid or other system) at the inlet to the gas exhaust orifice in order to filter out particles of liquid, or to position diaphragms at various different heights above the outlet orifices 8'.

Figure 9:
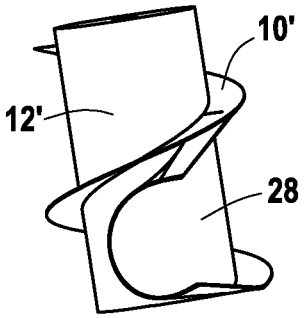
FIG. 9 is a perspective view showing a guide ramp that may be fitted to the manifolds of FIGS. 1 and 6.

In an advantageous provision of the invention, which is common to both of the above described embodiments, and which is shown in FIG. 9, the cylinder 12, 12' that carries the guide ramp 10, 10' also carries a deflector 28 that is positioned facing the inlet orifice. The deflector serves to assist the fluid in being guided by the guide ramp.

The invention claimed is:

1. A multiphase fluid manifold comprising a cylindrical enclosure having, at one longitudinal end, an inlet orifice and, at an opposite longitudinal end, at least four cylindrical outlet orifices axially symmetrically distributed around a longitudinal axis of the enclosure and aligned in a common plane extending transversely to the enclosure, each of the inlet and outlet orifices leading to or from the inside of the enclosure along a direction that is substantially tangential to the enclosure, the manifold further comprising fluid guide means for imparting helical motion to the fluid flowing inside the enclosure from the inlet orifice towards the outlet orifices;

wherein the at least four cylindrical outlet orifices are arranged to subdivide the flow in equal portions into a plurality of fluid flows, each having the same flow rate and the same composition.

2. The manifold according to claim 1, wherein the fluid guide means comprise a guide ramp in the form of a helix centered on the longitudinal axis of the enclosure.

3. The manifold according to claim 2, wherein the guide ramp is carried either by a cylinder centered on the longitudinal axis of the enclosure, or else by an inside wall of the enclosure.

4. The manifold according to claim 3, wherein the cylinder also carries a deflector positioned facing the inlet orifice to assist the fluid in being guided by the guide ramp.

5. The manifold according to claim 2, wherein the inlet orifice leads to the inside of the enclosure while forming an angle sloping towards the outlet orifices.

6. The manifold according to claim 5, wherein the angle sloping towards the outlet orifices of the inlet orifice is relative to a transverse axis of the enclosure that is substantially equal to an helix angle of the guide ramp.

7. The manifold according to claim 6, wherein the angle formed by the inlet orifice relative to the transverse axis of the enclosure lies in the range of 5° to 30°.

8. The manifold according to claim 1, further comprising a ring of erosion-resistant material centered on the longitudinal axis of the enclosure and positioned inside the enclosure, said ring being provided with a plurality of fluid-passing slots, each fluid-passing slot of said plurality of fluid-passing slots being positioned in register with a respective one of each of the outlet orifices.

9. The manifold according to claim 1, wherein the enclosure further comprises a gas exhaust orifice centered on the longitudinal axis of the enclosure and situated at the opposite longitudinal end of the enclosure where the outlet orifices are positioned.

10. The manifold according to claim 1, wherein the enclosure is formed by a sealed assembly of a vessel and a lid, the inlet orifice being formed in the vessel and the outlet orifices being formed in the lid.

11. The manifold according to claim 1, wherein the fluid guide means are configured to enable the fluid to make two turns around the longitudinal axis of the enclosure on going from the inlet orifice to the outlet orifices.

* * * * *